US006507965B2

(12) United States Patent
Kown

(10) Patent No.: US 6,507,965 B2
(45) Date of Patent: Jan. 21, 2003

(54) WASHING MACHINE WITH FUNCTIONAL WATER GENERATOR

(75) Inventor: Dong Heon Kown, Seoul (KR)

(73) Assignee: EcoAid Corp., Seoul (KR)

( * ) Notice: Subject to any disclaimer, the term of this patent is extended or adjusted under 35 U.S.C. 154(b) by 35 days.

(21) Appl. No.: 09/681,058

(22) Filed: Dec. 13, 2000

(65) Prior Publication Data

US 2002/0088061 A1 Jul. 11, 2002

(51) Int. Cl.[7] ..... D06F 39/00

(52) U.S. Cl. ..... 8/158; 8/159; 68/3 R; 68/235 R

(58) Field of Search ..... 68/3 R, 17 R, 68/17 A, 235 R; 335/302, 303, 306; 8/158, 159

(56) References Cited

U.S. PATENT DOCUMENTS 5,211,689 A * 5/1993 Kobayashi ..... 68/17 R X
5,309,739 A * 5/1994 Lee ..... 68/13 R X
5,682,774 A * 11/1997 Baumgartner ..... 68/235 R
5,946,951 A * 9/1999 Watanabe ..... 68/235 R
5,978,994 A * 11/1999 Anderson ..... 68/235 R X
6,012,308 A * 1/2000 Smulowitz ..... 68/235 R

* cited by examiner

*Primary Examiner*—Philip Coe
(74) *Attorney, Agent, or Firm*—Perkins Coie LLP

(57) ABSTRACT

The present invention teaches a washing machine having improved cleaning efficiency by adding a generator of functional waster such as ozone water or electroylzed water to a full-automatic washing machine. The washing machine includes a water supplier for supplying washing water, a washing tub containing the washing water and a laundry, a functional water generator inside the washing tub, and an agitator for agitating the washing water and the laundry. When the washing water supplied to the washing tub reaches a predetermined level, the functional water generator generates ozone water or electrolyzed water, which is then mixed by the agitator. Thus, partial decolorization or damage of laundry can be prevented. Also, since ozone water or electrolyzed is maintained in the washing tub in a constant concentration, the laundry can be sterilized, disinfected, bleached and deodorized without being heated, which avoids damage to the laundry.

13 Claims, 15 Drawing Sheets

WASHING MACHINE WITH FUNCTIONAL WATER GENERATOR

BACKGROUND OF INVENTION

1. Field of the Invention

The present invention relates to a washing machine with a functional water generator and a washing method thereof, and more particularly, to a washing machine having improved cleaning efficiency by adding a generator of functional water such as ozone water or electrolyzed water to a full-automatic washing machine, and a washing method thereof.

2. Description of the Related Art

Currently, full-automatic washing machines in which laundry washing, rinsing and dewatering are sequentially performed, are widely used. Also, there have been developed a washing machine with a filtering system for increasing cleaning efficiency and a washing machine with an ozone generator for sterilizing, disinfecting or bleaching the laundry.

An example of the washing machine with an ozone generator is disclosed in Korean Patent Publication No. 1996-14275. FIG. 1 illustrates a conventional washing machine in which ozone gas is generated in the air and then the generated ozone gas is dissolved into water. Referring to FIG. 1, the conventional washing machine includes first and second water supply valves 81 and 82 installed in a body to be selectively opened or closed for supplying hot water or cold water to a tub 80, a filter 85 for filtering washing water introduced through the first and second water supply valves 81 and 82 and first and second solenoid valves 83 and 84, an ozone gas generator 87 for generating ozone gas by driving an air pump 86, a sprinkler 88 for introducing the ozone gas generated by the ozone gas generator 87 into the tub 80, and a catalyst filter 89 for removing undissolved ozone gas introduced into the tub 80.

In the aforementioned washing machine, when the level of washing water in the tub 80 comes to a predetermined level after beginning water supply, ozone gas is generated from the ozone gas generator 87 by driving the air pump 86 disposed under the tub 80. The generated ozone gas is introduced into the tub 80 through a plurality of holes each having a diameter of 10 $\mu$m or less of the sparkler 88 which is made of ceramic and installed at one side of a pulsator on the bottom of the tub 80, and at the same time the washing water in the tub 80 is agitated by rotation of the pulsator, thereby dissolving the ozone gas. The undissolved ozone gas moves upward in the tub 80 to be removed by the catalyst filter 89 which is installed in the upper portion of the tub 80 out of contact with the washing water.

However, an ozone gas requires a considerable time to be dissolved in water, and the time is dependent upon the shape and size of the ozone gas when it is brought into contact with water. In particular, ozone gas particles with small size are advantageously dissolved in water. Thus, in a washing machine based on a method in which ozone gas is generated in the air and then dissolved in water, a separate device is required for making ozone gas into fine particles. Further, the undissolved ozone gas emanated into the air would be harmful to the user. Thus, it is necessary to remove the harmful ozone gas using a separate device, which increases financial burden of equipment. Also, the user's safety cannot be ensured due to the emanated ozone gas. As described above, the conventional washing machine with an ozone gas generator worked in the air has many problems.

Alternative washing machine with an ozone generator is disclosed in Korean Patent Publication No.1992-7734, in which ozone is generated by hydrolysis of water and the obtained ozone water is supplied for washing. FIG. 2 illustrates a conventional washing machine in which ozone is generated in water. The washing machine, which is configured to sequentially perform washing, rinsing and dewatering, includes a water supply valve 91 for automatically supplying or blocking tap water and a water supply tube 92 for introducing the water into a washing tub. An ozone generator 93 is provided between the water supply valve 91 and the water supply tube 92 so as to generate ozone water simultaneously with supplying of water for a final rinsing step. The ozone generator 93 having an inlet conduit in its upper portion, an outlet conduit it its lower portion, and upper and lower cases tightened by threads is connected to a water supply tube of the washing tub, thereby directly supplying ozone water into the washing machine simultaneously with water supply.

However, according to the above-described washing machine with an ozone generator installed on a water supply tube for generating ozone in water, the ozone water is directly supplied to the laundry, resulting in decolorization or damage of the laundry. Also, since the action of oxidizing power starts with the supply of the ozone water, the duration of the reaction time is short. Further, the concentration of the ozone water is undesirably variable due to the flux of supplied water.

SUMMARY OF INVENTION

To solve the problems encountered in the conventional washing machine with an ozone generator, it is an object of the present invention to provide a washing machine having improved cleaning efficiency, which is additionally installed with a simple device for generating functional water in washing water supplied to a washing tub in a full-automatic washing machine, to generate functional water such as ozone water or electrolyzed water. The functional water is consistently act on the laundry in a constant concentration, which prevents partial decolorization or damage of the laundry and simultaneously perform sterilization, disinfection and bleaching of the laundry, thereby improving a degree of cleaning while reducing the use amount of detergent.

To accomplish the above object of the present invention, there is provided a washing machine including a water supplier for supplying washing water, a washing tub for containing the washing water supplied from the water supplier and a laundry, a functional water generator installed inside the washing tub, and an agitator for agitating the washing water and the laundry contained in the washing tub.

The functional water generator, which generates functional water in the washing water supplied to the washing tub, is preferably provided in the lower portion of the washing tub. Particularly, the functional water generator may be an ozone water generator having at least one pair of facing electrodes or an electrolyzed water generator having at least one pair of facing electrodes disposed with a separating layer interposed therebetween. The facing electrodes are preferably made of platinum (Pt), a platinum/palladium (Pt/Pd) alloy or a Pt group/Pd alloy. Further, the facing electrodes may be made of a conductive metal coated with platinum (Pt), a platinum/palladium (Pt/Pd) alloy or a Pt group/Pd alloy. The conductive metal is preferably titanium (Ti). In the case of using the Pt/Pd alloy, 85.0 to 99.95 wt % of Pt and 15.0 to 0.05 wt % of Pd are preferably contained in the alloy. Also, the facing electrodes are preferably carbon electrodes having electric conductivity.

The facing electrodes may be of a panel type, a flat panel type having one or more holes, a small strip type, a fine wire type, a fish bone type, a mesh type or a cylinder type. The distance of the facing electrodes is preferably in the range of 0.1 to 1 mm.

Also, the washing machine may further include a power source for applying a direct-current (DC) voltage, a pulse voltage, a square wave pulse voltage, a sequence-controlled pulse voltage or an alternating pulse voltage to the functional water generator.

The washing machine may further include a power source for applying a voltage to the functional water generator, a sensor for sensing whether the washing water supplied from the water supplier reaches a predetermined level in the washing tub, and a controller for receiving information of the level of the washing water in the washing tub from the sensor and controlling the voltage to be applied to the power source. Also, the washing machine may further include a power source for applying a voltage to the functional water generator, a sensor for sensing the concentration of the functional water in the washing tub, and a controller for receiving information of the concentration of the functional water from the sensor and controlling the voltage to be applied to the power source. Here, the controller may further controls the operations of a water supply valve for supplying the washing water to the washing tub and a drain valve for draining the washing water from the washing tub.

There is further provided a washing machine including means for supplying washing water to a washing tub, means for generating functional water in the washing water supplied to the washing tub, means for mixing a laundry with the functional water, and means for draining the functional water.

The functional water is ozone water or electrolyzed water, and the electrolyzed water is acid water, alkali water or neutral water.

According to another aspect of the present invention, there is provided a washing method performed by a washing machine, including the steps of supplying washing water to a washing tub, generating functional water in the washing water supplied to the washing tub, mixing a laundry with the functional water, and draining the functional water.

The washing method may further include the steps of sensing the level of the washing water supplied to the washing tub, and controlling the generation of the functional water in accordance with the level of the washing water. Also, the washing machine may further including the steps of sensing the concentration of the functional water in the washing tub, and controlling the generation of the functional water in accordance with the concentration of the washing water.

In the present invention, the functional water generator for generating functional water having various functions of sterilization, disinfection, bleaching or deodorization, is installed in the washing tub of the washing machine. The functional water is generated after the washing water is supplied to the washing tub. According to the present invention, the functional water generator includes at least one pair of facing electrodes so that when a voltage is applied to the electrodes, the functional water is generated while the water supplied to the washing tub is electrolyzed. The functional water generator is positioned in the lower portion of the washing tub, preferably under the agitator. When the washing water supplied from the water supplier reaches a predetermined level in the washing tub, the generation of the functional water begins, and the agitator also starts operating, therefore, the concentration of ozone or electrolyte in the water is maintained at a constant level for a long time in the washing machine according to the present invention. While the conventional washing machine with an ozone generator connected to a water supply pipe causes partial decolorization and damage of the laundry due to non-uniformity of the ozone concentration in the washing water, the washing machine according to the present invention performs a sterilization, disinfection, bleaching and deodorization of the laundry without such decolorization and damage. Therefore, the cleaning degree can be improved while reducing the amount of detergent used, thereby improving the cleaning efficiency.

BRIEF DESCRIPTION OF DRAWINGS

The above object and advantages of the present invention will become more apparent by describing in detail a preferred embodiment thereof with reference to the attached drawings in which:

FIGS. 8A and 8B are cross-sectional views of a washing machine with a functional water generator according to another embodiment of the present invention, in which FIG. 8A is a front sectional view and FIG. 8B is a side sectional view;

FIGS. 9A through 9D illustrate an example of an ozone water generator for use in the washing machine according to the present invention, in which FIG. 9A shows one of two facing electrodes, FIG. 9B shows a spacer for maintaining a gap between the facing electrodes, FIG. 9C shows an electrode fixing frame, and FIG. 9D shows a bare-type ozone water generator;

DESCRIPTION OF THE PREFERRED EMBODIMENTS

The present invention will now be described by the following embodiments in more detail with reference to the accompanying drawings. However, these embodiments are illustrations only provided for a better understanding of the invention, not for the purpose of limiting.

Figure 1:
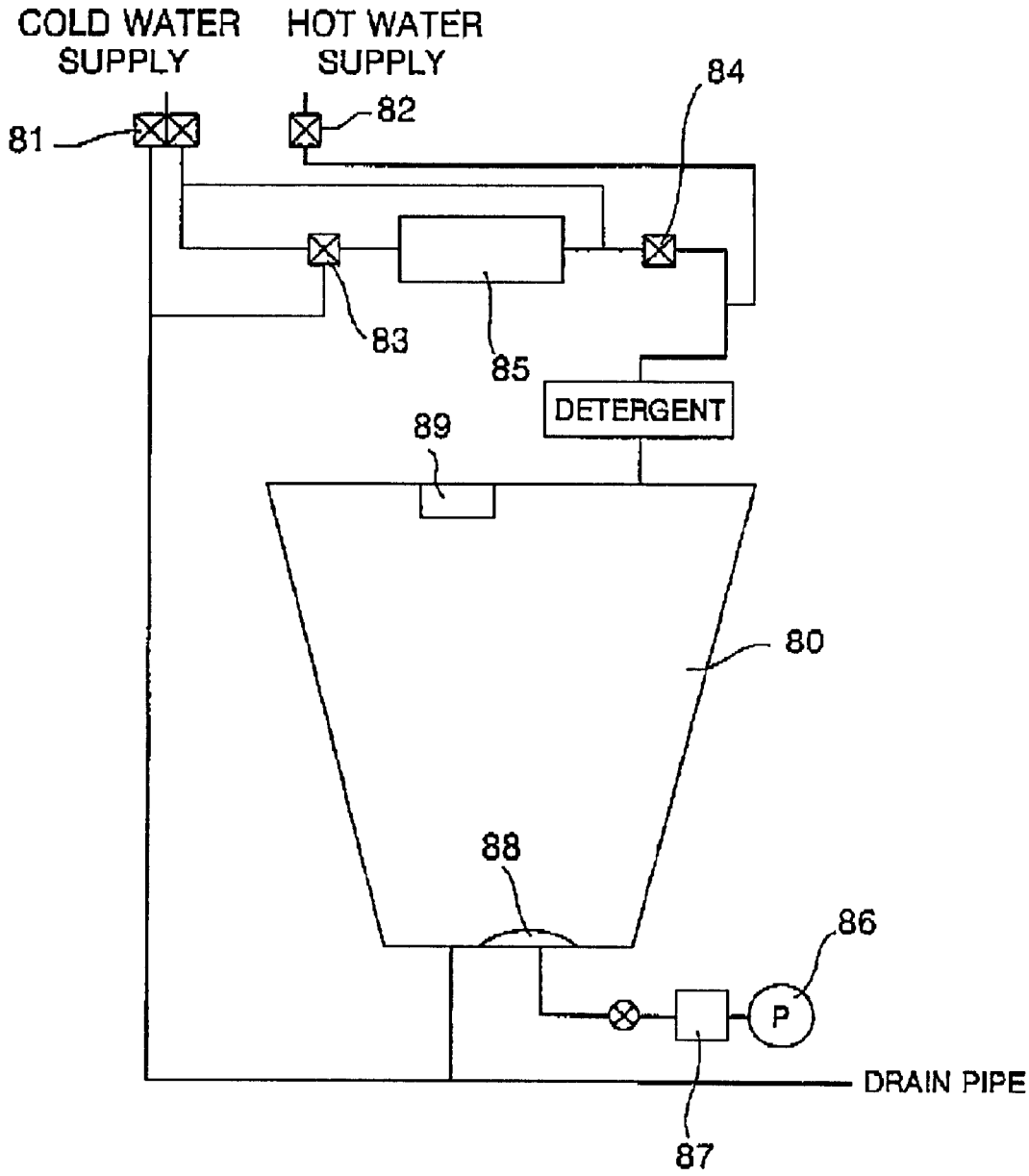
FIG. 1 (PRIOR ART)
FIG. 1 illustrates a conventional washing machine in which ozone gas is generated in the air and then dissolved in water.
Figure 2:
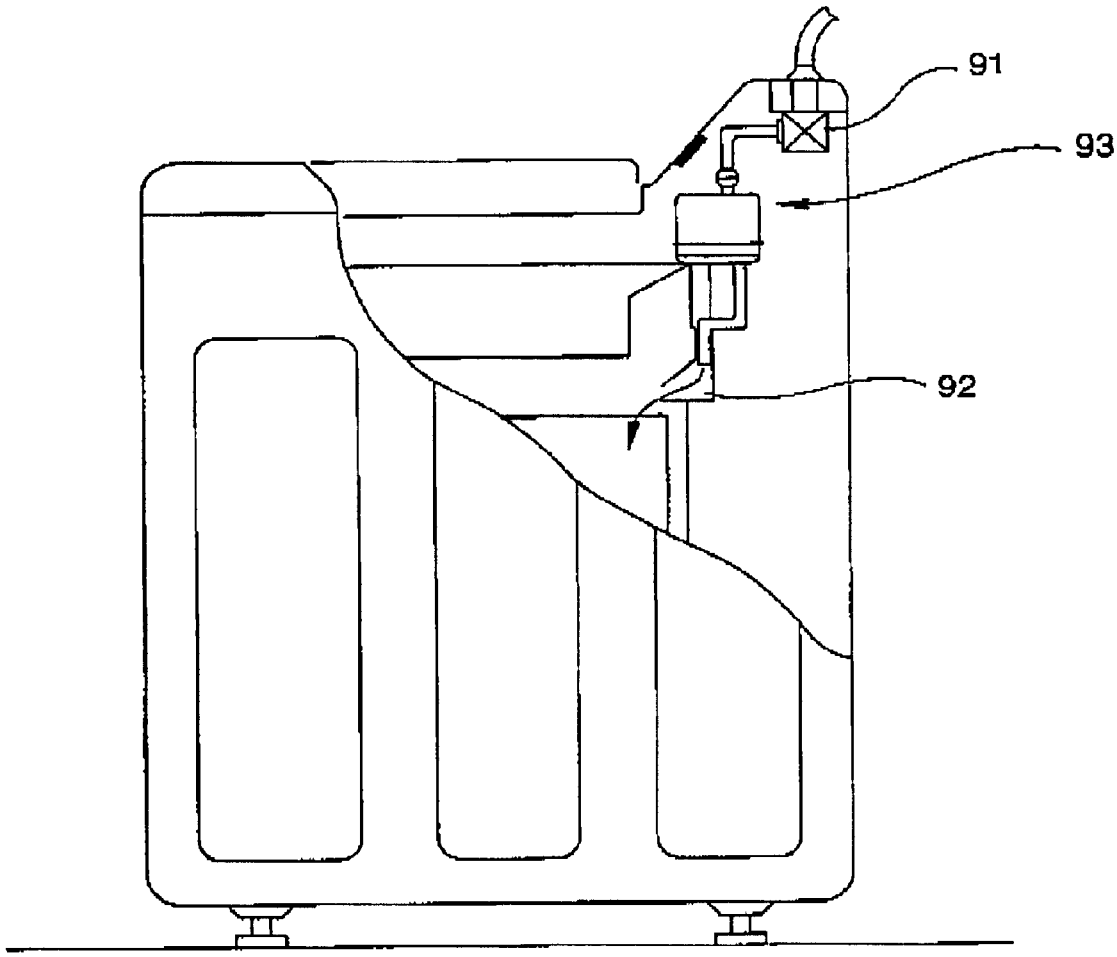
FIG. 2 (PRIOR ART)
FIG. 2 illustrates another conventional washing machine in which ozone is generated in water.
Figure 3:
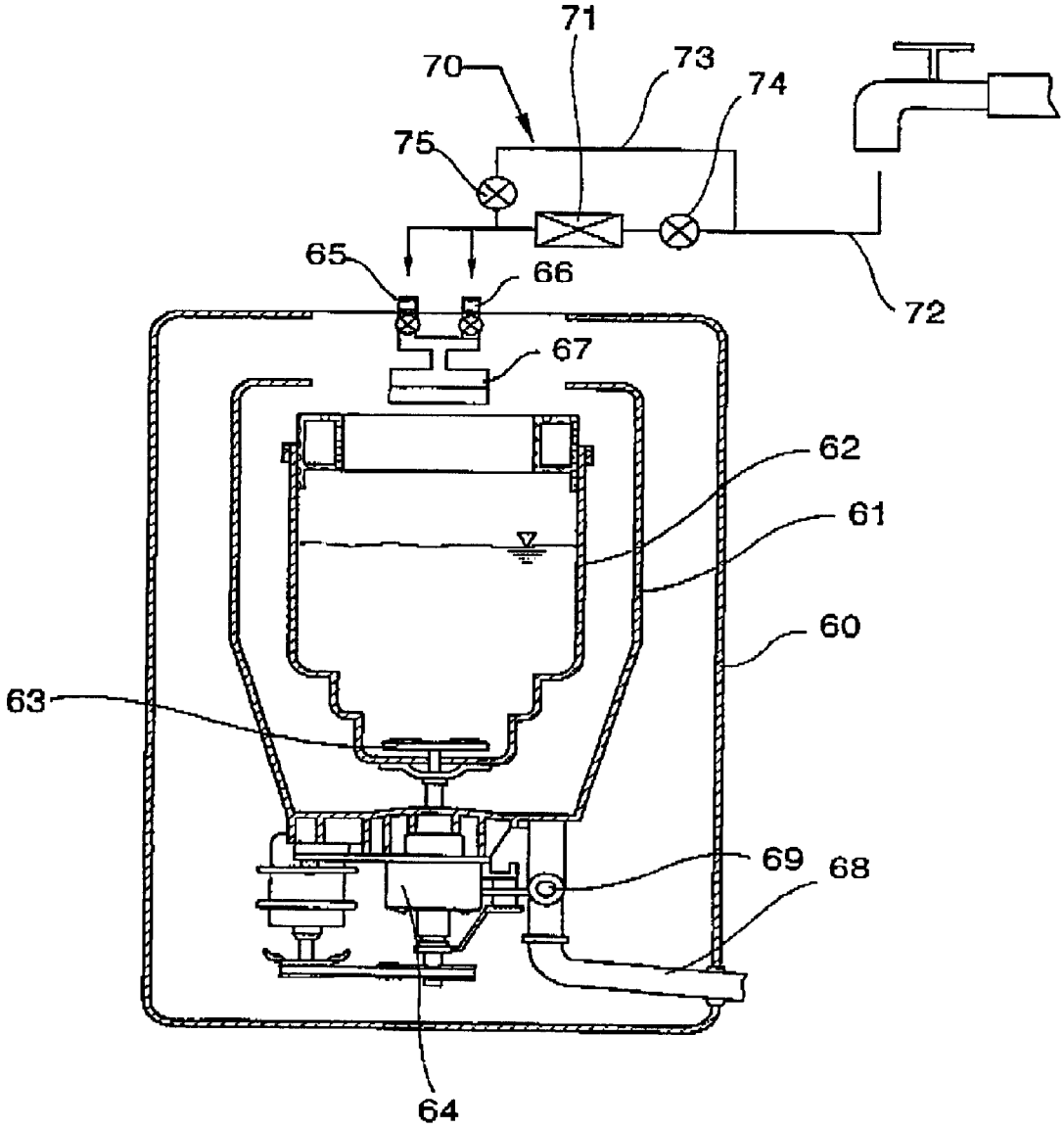
FIG. 3 (PRIOR ART)
FIG. 3 illustrates still another conventional washing machine with a filtering system.

Prior to detailed description of the structure of a washing machine according to the present invention, the structure and operation of a conventional full-automatic washing machine will first be described. FIG. 3 shows a structure of a conventional washing machine with a filtering system, in which a water tub 61 containing washing water and a washing tub 62 containing laundry are provided inside a housing 60. A driving motor 64 for rotating a rotating blade 63 is installed in the lower portion of the water tub 61. Cold and hot water supply tubes 65 and 66 for supplying washing water to the inside of the water tub 61, and a detergent container 67 are provided in the upper portion of the housing 60. Also, a drain duct 68 and a valve 69 are installed in the lower portion of the housing 60. A filtering means 70 for selective filtering of tap water is provided outside the housing 60. The filtering means 70 includes a filter 71 for filtering tap water, a conduit 72 by which the tap water is transmitted to the cold and hot water supply tubes 65 and 66 through the filter 71, and a conduit 73 through which the tap water is transmitted to the cold and hot water supply tubes 65 and 66 without passing through the filter 71. Valves 74 and 75 for opening/closing the conduits 72 and 73 in accordance with a control signal, are provided in the conduits 72 and 73, respectively.

The operation of the conventional washing machine is performed as follows. First, a user selects either a filtered water supply mode or a normal water supply mode. During a normal water supply mode, the valve 74 is closed and the valve 75 is opened so that the tap water is transmitted to the cold and hot water supply tubes 65 and 66 through the conduit 73. The washing water is then supplied together with detergent of the detergent container 67. During a filtered water supply mode, the valve 75 is closed and the valve 74 is opened so that the tap water is transmitted to the filter 71 through the conduit 72. The washing water is filtered and then transmitted to the cold and hot water supply tubes 65 and 66 through the conduit 72. The washing water is supplied together with detergent of the detergent container 67. The supplied water is introduced into the water tub 61 and then flows into the washing tub 62 when the water reaches a predetermined level. Then, along with the rotation of the rotating blade 63, actuated by the driving motor 64, the washing process starts. After the washing process is completed, the valve 69 is opened so that the water in the washing tub 62 is drained through the drain duct 69. In a subsequent rinsing process, the water is supplied without passing through the detergent container 67 and the detergent remained in the laundry is repeatedly washed out and drained. Then, in a dewatering process, water is not supplied.

Next, the structure and operation mechanism of a washing machine according to the present invention will be described compared to those of the conventional washing machine.

Figure 4:
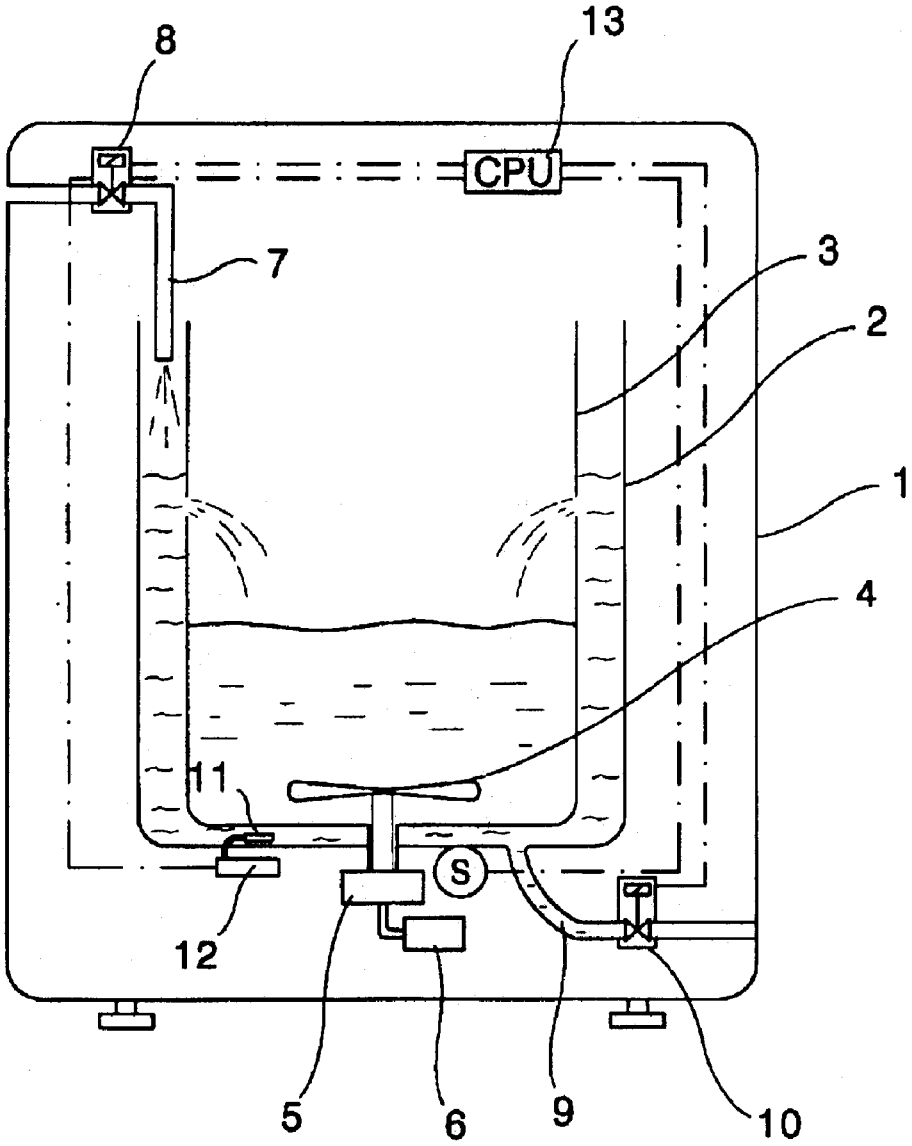
FIG. 4 is a cross-sectional view of a washing machine with a functional water generator according to an embodiment of the present invention.
Figure 5:
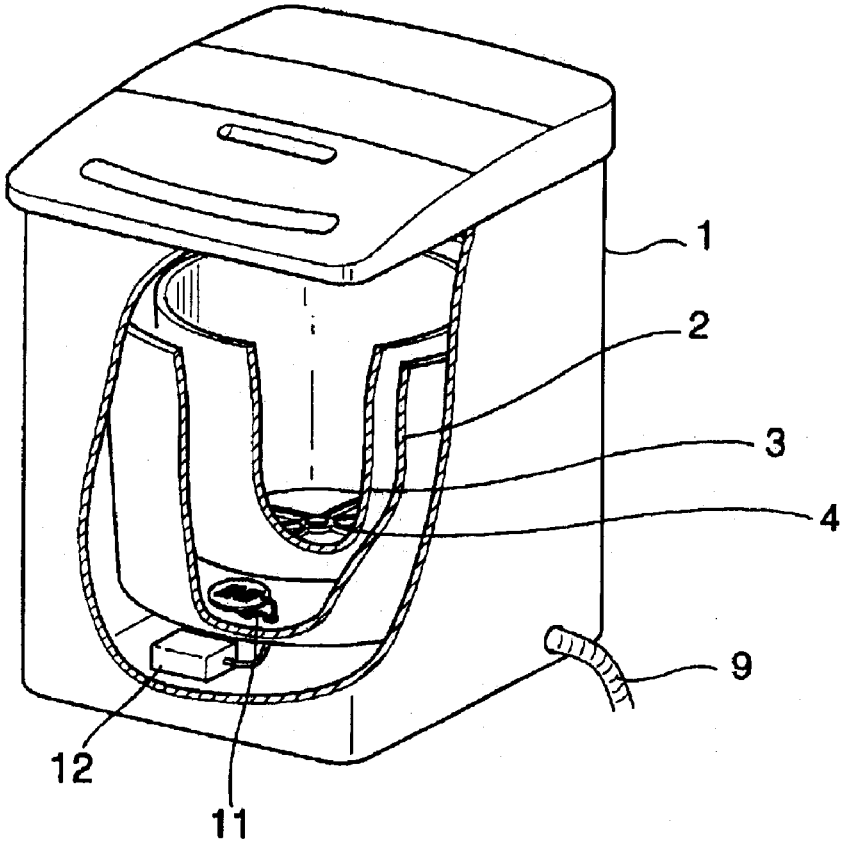
FIG. 5 is an exploded perspective view of essential parts of the washing machine with a functional water generator according to the present invention.

FIGS. 4 and 5 illustrate an embodiment of a washing machine with a functional water generator according to the present invention, in which FIG. 4 is a cross sectional view thereof, and FIG. 5 is an exploded perspective view of essential parts thereof. Like the conventional washing machine, the washing machine according to the present invention includes a water tub 2 containing washing water and a laundry tub 3 containing a laundry inside a housing 1, which are provided around a rotation shaft. In the present invention, both the water tub 2 and the laundry tub 3 will be referred to as a washing tub. An agitator 4 is mounted in the lower portion of the washing tub around the rotation shaft and is connected to a motor 6 via a clutch 5, a power intermittence device. In this embodiment, rotating blades are shown and illustrated as an agitator 4. However, the rotating washing tub itself may also be regarded as an agitator in the present invention. A water supplier 7 and a water supply valve 8 for supplying washing water into the water tub 2 are provided in the upper portion of the housing 1. A drain duct 9 and a drain valve 10 are installed in the lower portion of the washing tub. The aforementioned configuration is the same as that of the conventional washing machine.

A functional water generator 11 is installed under the agitator 4 in the lower portion of the washing tub, in particular, in the water tub 2, and a power source 12 for applying a voltage is connected to the functional water generator 11. Also, a controller (CPU) 13 for controlling the operation of the power source 12 is installed. A sensor (S), which is mounted under the bottom of the washing tub, senses the height of washing water in the washing tub by measuring water pressure and transmits the signal to the controller 13. The controller 13 is configured to control opening/closing of the water supply valve 8 and the drain valve 10 as well as the power source 12 of the functional water generator 11.

Figure 6:
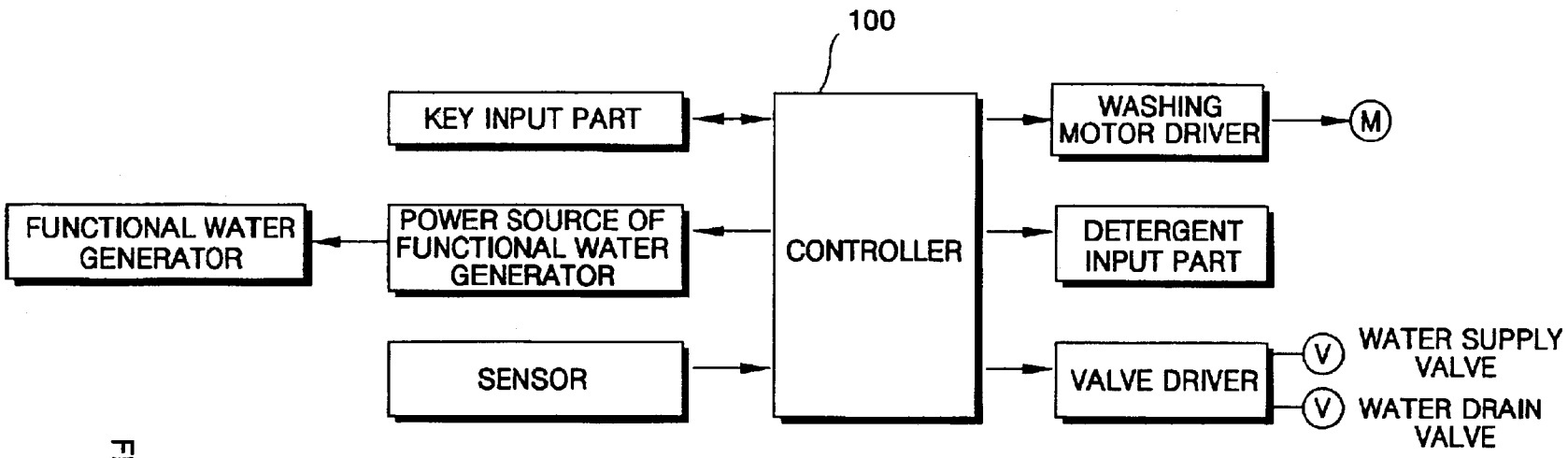
FIG. 6 is a control block diagram showing the operation of the washing machine with a functional water generator according to the present invention.

The operation of the aforementioned washing machine according to the present invention will now be described with reference to FIG. 6, which is a control block diagram showing the operation of the washing machine with a functional water generator according to the present invention. Like the conventional washing machine, the washing machine according to the present invention starts to operate when a user selects a START menu by means of a key input part. First, the water supply valve 8 is opened by the signal of the controller 13 and washing water is introduced to the water tub 2 through the water supplier 7. As the water tub 2 is filled with the washing water, the washing water finally flows into the laundry tub 3. When the height of the washing water reaches a predetermined level, it is sensed by the sensor S mounted under the bottom of the washing tub and the signal is transmitted to the controller 13. When a voltage is applied from the controller 13 to the power source 12 in accordance with the signal from the sensor S, the operation of the functional water generator 11 is initiated so that the water in the washing tub is electrolyzed to generate functional water. The operation of the functional water generator is controlled by the concentration of the functional water in the washing tub. When the concentration of the functional water in the washing tub reaches a predetermined level and is sensed by the sensor, the controller stops the voltage applied to the power source 12, so that the functional water generator 11 stops operating. Subsequent to the operation of the functional water generator 11, the agitator 4 starts to operate by a washing motor driver, so that the fluid containing functional water is mixed with the laundry, and washing process is performed with sterilization, disinfection, bleaching and deodorization processes. When the washing process is completed, the drain valve 8 is opened in accordance with the signal of the controller 13 so that washing water is drained through the drain duct 9. A detergent input unit may also be controlled by the controller 13. The detergent is introduced during the washing process but not introduced during the rinsing process.

Figure 7:
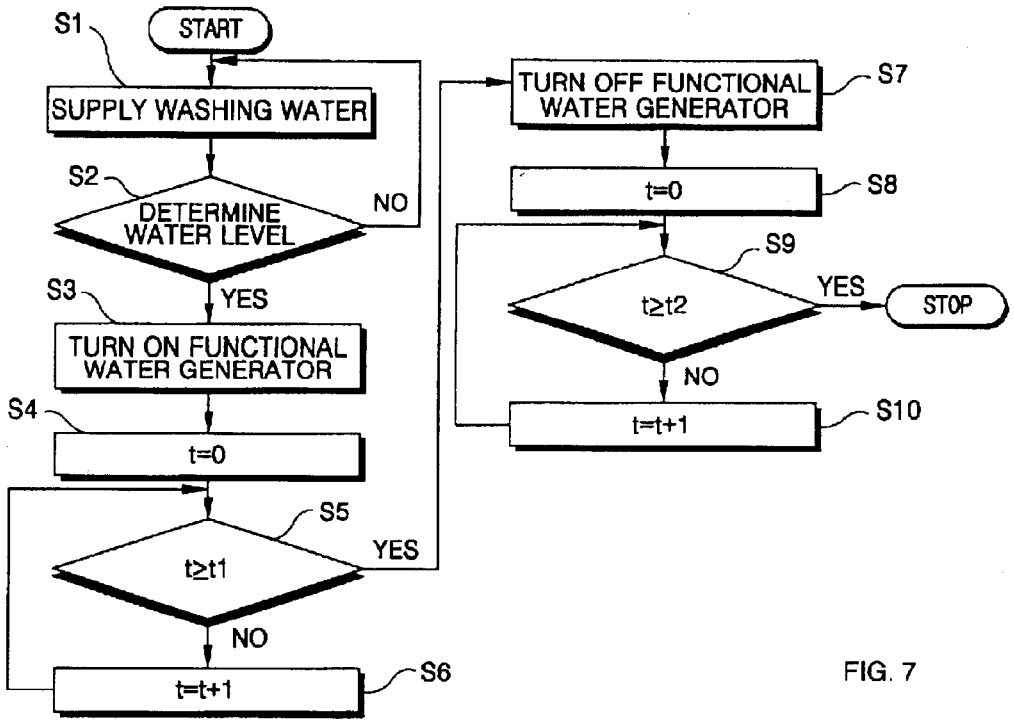
FIG. 7 is a flow diagram showing the operation of the functional water generator provided in the washing machine according to the present invention.

FIG. 7 is a flow diagram showing the operation of the functional water generator provided in the washing machine according to the present invention. As shown in FIG. 7, when the operation of the washing machine is initiated, washing water is supplied in accordance with a signal from a controller, indicative of the opening of a water supply valve (step S1). It is determined by a sensor positioned under the bottom of the washing tub whether the height of water in a washing tub reaches a predetermined level (step S2), and if yes, the operation of a functional water generator is controlled to be initiated by the controller (step S3). Then, the concentration of the functional water contained in the washing tub is sensed, and if the concentration reaches a predetermined level (steps S4–S6), the functional water generator stops operating (step S7). Here, t1 means an operating time of the functional water generator. As an agitator is actuated, the functional water is mixed with the laundry. Then, a washing process starts along with sterilization, disinfection, bleaching and deodorization of the laundry. After the lapse of a predetermined time until the washing process is completed, the washing machine stops operating (steps S8–S10). t2 means a washing process time. If the washing process is completed, a drain valve is opened so that the washing water is drained through a drain duct. In a rinsing process, like in the washing process, the steps of supplying washing water, operating the functional water generator and stopping the same, rinsing and draining, are sequentially performed. The operation of functional water generator can be controlled selectively by purpose. For example, for the purpose of sterilizing or disinfecting the laundry, the functional water generator is sufficient to operate only in the washing process. However, for the purpose of bleaching the laundry, the functional water generator is preferable to operate in the rinsing process as well as in the washing process.

Figure 8A:
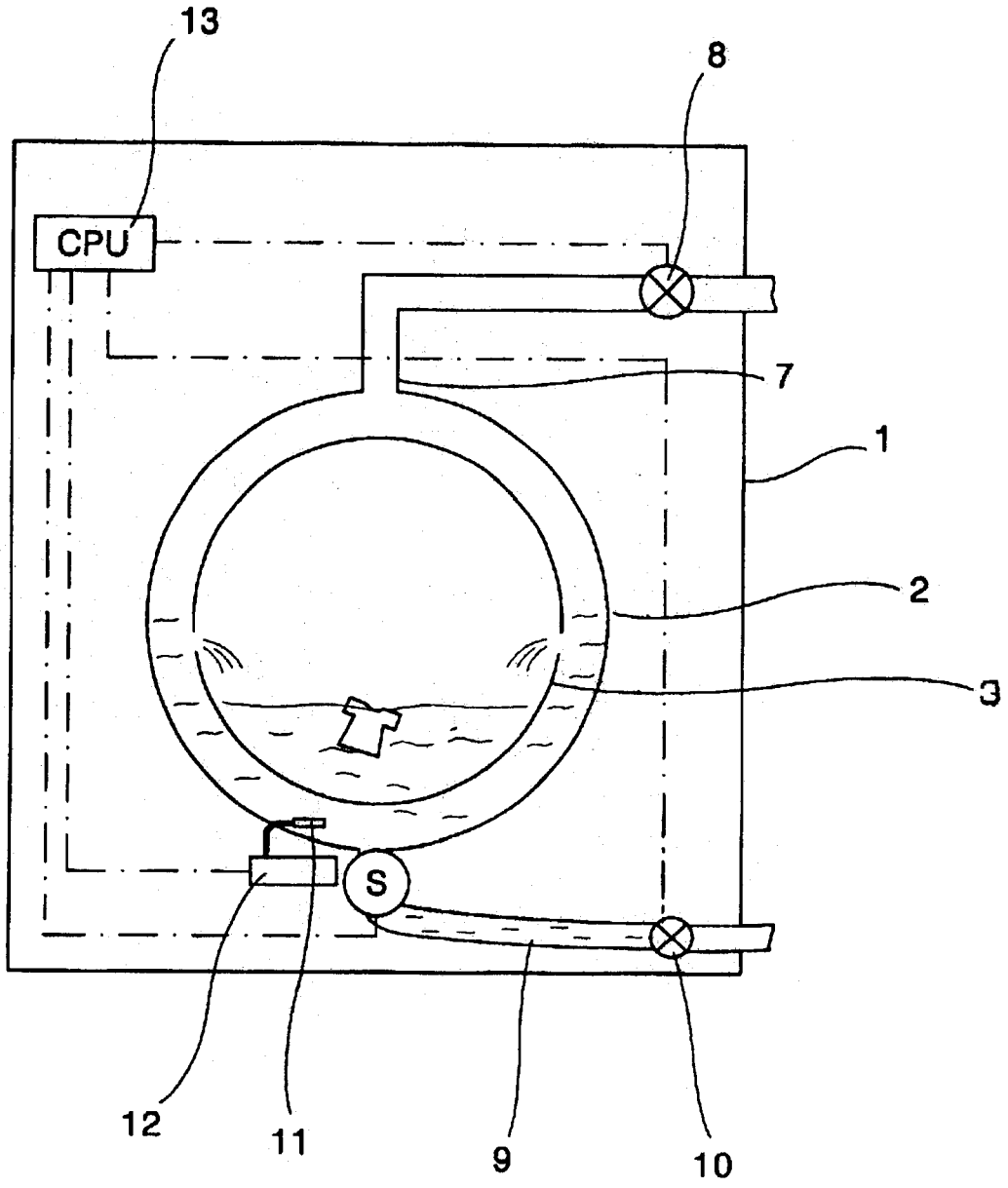
Figure 8B:
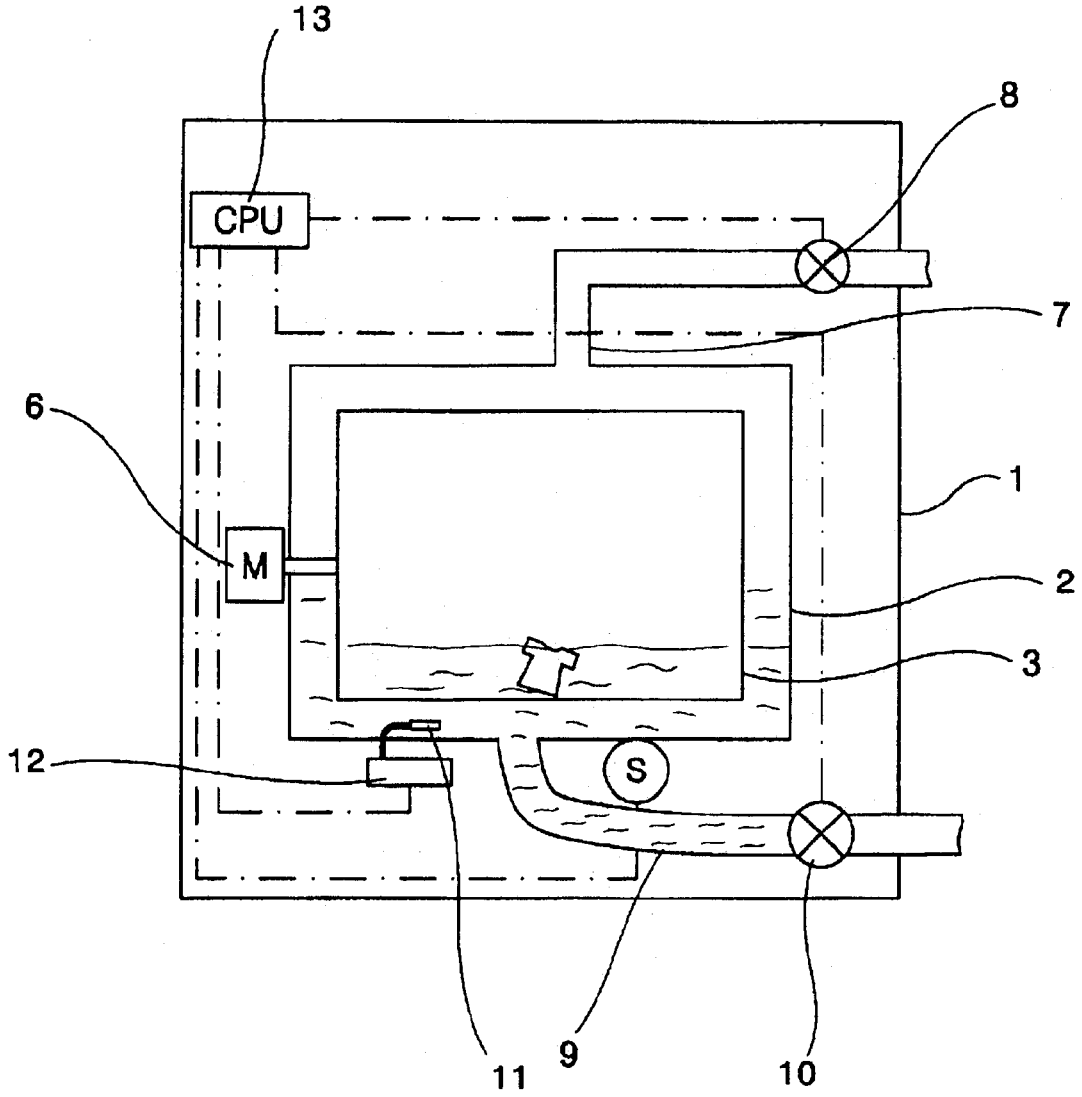

FIGS. 8A and 8B are cross-sectional views of a washing machine with a functional water generator according to another embodiment of the present invention, in which FIG. 8A is a front sectional view and FIG. 8B is a side sectional view. Whereas the washing machine shown in FIG. 4 is a vertical type washing machine in which a washing process is performed while a cylindrical washing tub rotates around a vertical rotation shaft, the washing machine shown in FIG. 8 is a horizontal type washing machine in which a cylindrical washing tub rotates around a horizontal shaft. The horizontal type washing machine is widely used in America, Europe or the like, and is also called a drum type washing machine. As shown in FIGS. 8A and 8B, the washing machine according to this embodiment includes a water tub 2 containing washing water, and a laundry tub 3 containing a laundry around a horizontal rotation shaft in a housing 1. The washing machine is designed such that the laundry tub 3 rotates by the driving of a motor 6 installed in the rear portion of the housing 1. In this embodiment, the washing tub itself serves as an agitator. Except the structure of the agitator, the washing machine of this embodiment has the same elements as those of the vertical type washing machine shown in FIG. 4, and the operation thereof is controlled in the same manner as that shown in FIG. 4.

A functional water generator mounted in the washing machine according to the present invention will now be described in detail. In the present invention, the functional water may be either ozone water or electrolyzed water. Thus, the functional water generator of the present invention may include an ozone water generator and an electrolyzed water generator.

Figure 9A:
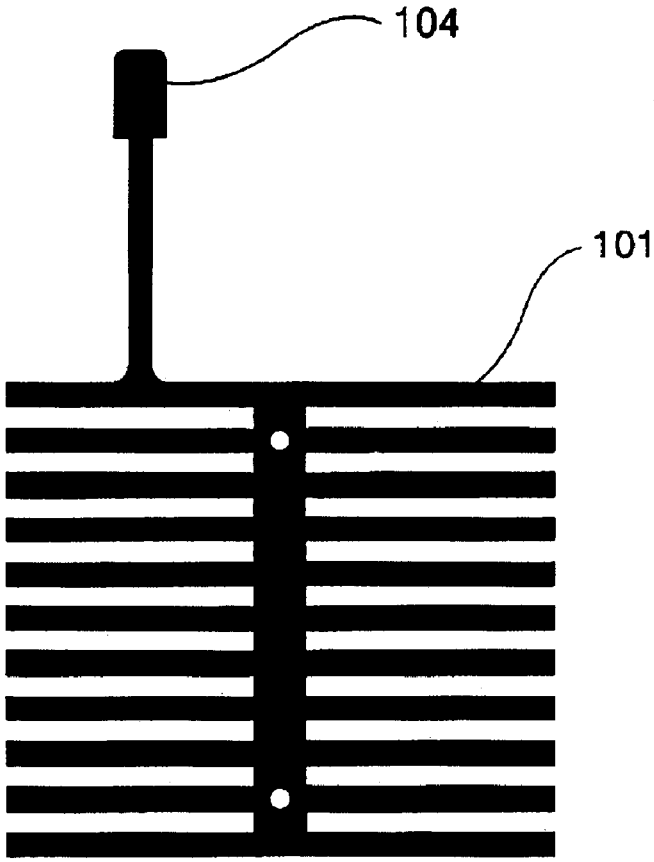
Figure 9B:
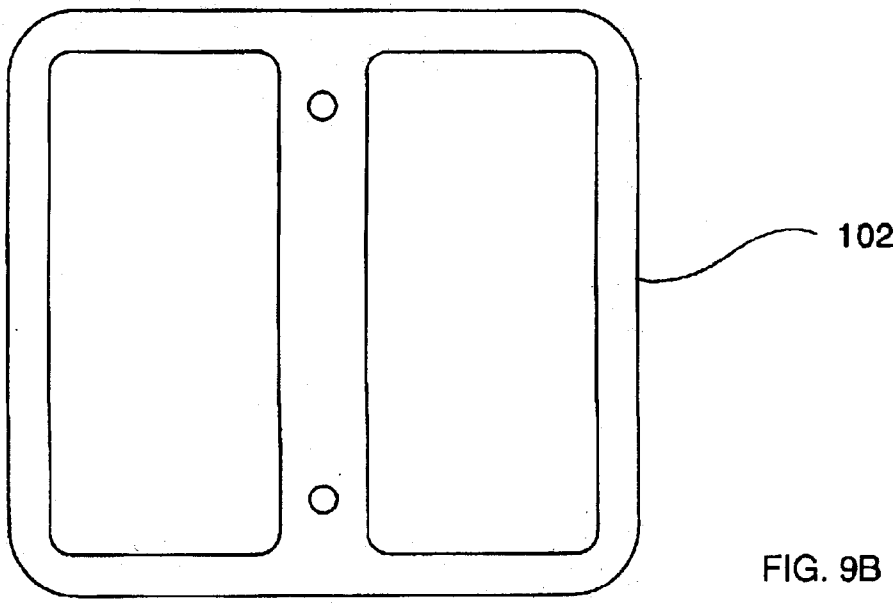
Figure 9C:
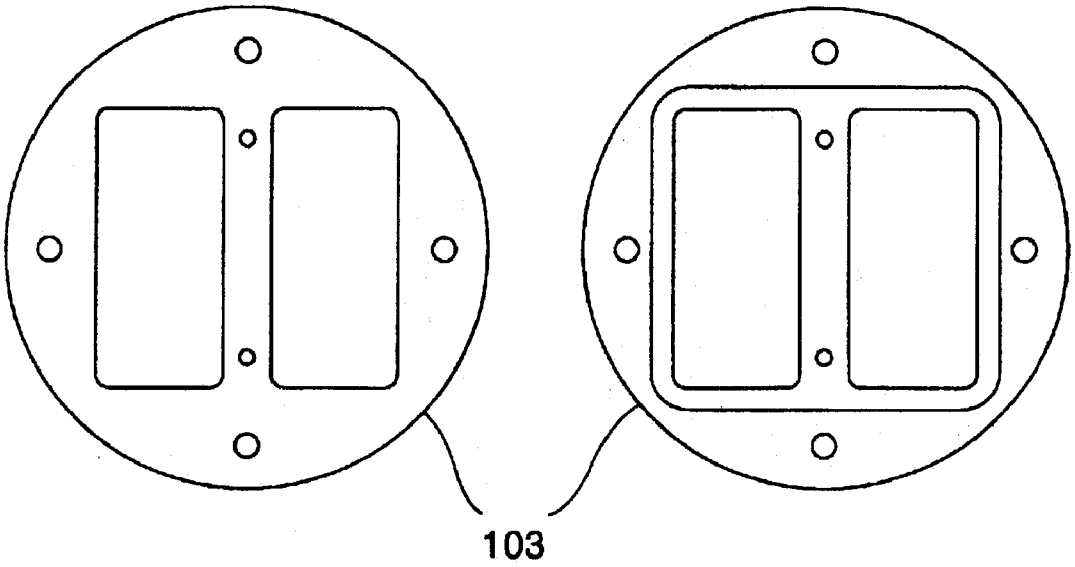
Figure 9D:
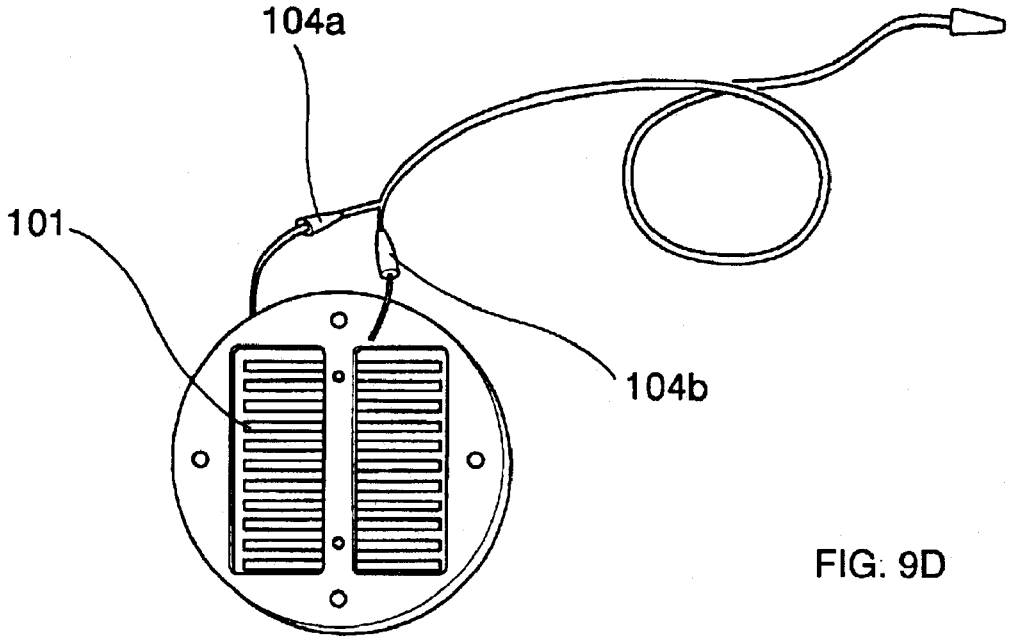

First, the ozone water generator includes at least one pair of facing electrodes. FIGS. 9A through 9D and FIG. 10 illustrate examples of an ozone water generator that can be used for a washing machine according to the present invention. FIG. 9A shows one of a pair of facing electrodes 101*a* and 101*b*, of a fish bone type, FIG. 9B shows a spacer 102 for maintaining a gap between a pair of facing electrodes, FIG. 9C shows an electrode fixing frame 103, and FIG. 9D shows an ozone water generator fixed on a frame, in which a pair of facing electrodes is vertically disposed with a spacer interposed therebetween. The ozone water generator shown in FIGS. 9A through 9D is generally called a bare type or nude type ozone water generator having bare electrodes, and is directly put into water as used. External electrode connection terminals 104*a* and 104*b* are provided at one side of each of the facing electrodes 101*a* and 101*b*, respectively. When a voltage is applied to the external electrode connection terminals 104*a* and 104*b*, water molecules are decomposed between the facing electrodes 101*a* and 101*b* in water to generate ozone, thereby generating ozone water. The bare type ozone water generator is not required to be fixed in water and can be preferably used when control of water flow is not required. Thus, in the washing machine according to the present invention, the ozone water generator of bare type is positioned in the lower portion of the washing tub, in particular, at any position in the water tub 2, without being fixed.

Figure 10:
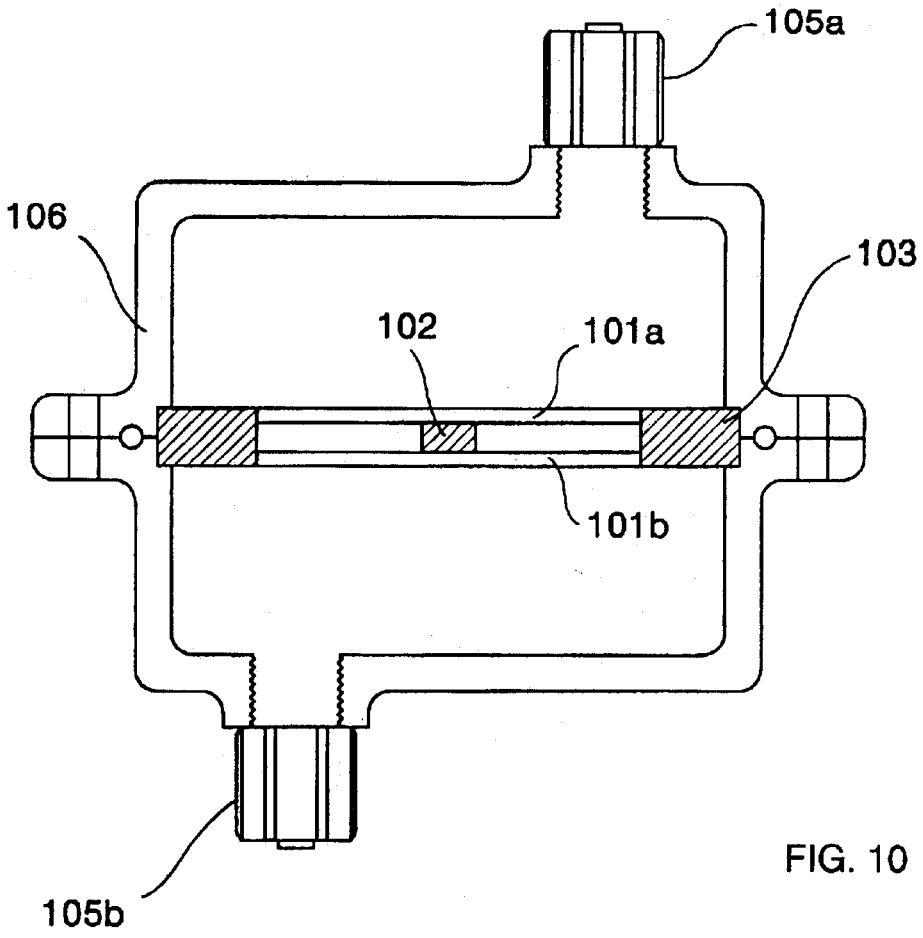
FIG. 10 is a cross-sectional view showing another example of an ozone water generator for use in the washing machine according to the present invention.

FIG. 10 is a cross-sectional view showing another example of an ozone water generator for use in the washing machine according to the present invention. The ozone water generator includes a pair of facing electrodes 101*a* and 101*b* vertically disposed with a spacer 102 interposed therebetween and then fixed to a frame 103. The ozone water generator, mounted inside a container 106 having water inlet and outlet 105*a* and 105*b*, is generally called a cell type ozone water generator. Since the ozone water generator of cell type has water inlet and outlet, it may be fixed to the wall or bottom and be preferably used when control of water flow is required. In the washing machine of the present invention, the water inlet and outlet of the ozone water generator of cell type may be widened and it is preferably fixed to the lower portion of a washing tub, in particular, on the wall of the water tub 2.

The electrolyzed water generator that may be used for a washing machine according to the present invention is constructed such that a positive electrode and a negative electrode face to each other with a separating layer disposed therebetween in a case having a water supply duct and an electrolyzed water drain duct. When water passes from the water supply duct through the facing electrodes, it is electrolyzed by a voltage applied to the electrodes to generate acid water and alkali water, which is drained through the drain duct. In the electrolyzed water generator, the positive electrode water output from the drain duct of the positive electrode is acid water containing strongly acidic materials, for example, a large amount of $O_3$ and trivial amounts of $O_2$, O and $H_2O_2$, that is, containing many anions. The negative electrode water output from the drain duct of the negative electrode is alkali water containing many cathions. The amount and ion concentration of the strongly acidic materials such as $O_3$, $O_2$, O, $H_2O_2$ or the like, can be easily adjusted by controlling the magnitude or cycle of the voltage applied manually or automatically, for example, by using an automatic control circuit. Also, the amount and ion concentration of the strongly acidic materials can be adjusted by varying the sizes of electrodes, the distance between electrodes, the width or amount of water flow. Further, weak alkali water and weak acid water as well as neutral water of pH 7 can be made by using a means for mixing and neutralizing the positive electrode water (strong acid water) and the negative electrode water (strong alkali water) output through the drain ducts of the respective electrodes. Such neutral water contains a considerable amount of oxidizing materials generated by discharge and electrolysis, therefore, has a sufficient sterilizing and disinfecting effect. Thus, the neutral water can also be advantageously used for the purpose of sterilization and disinfection of washing water and laundry.

In case the electrolyzed water generator is installed in the washing machine according to the present invention, acid water, alkali water or neutral water can be selectively prepared based on the option by a controller. Thus, the electrolyzed water of an appropriate type can be generated for use according to the purpose of the washing process, that is sterilization, disinfection, deodorization or bleaching of laundry. For example, the laundry is washed with acid water for sterilization/disinfection, and then rinsed with weak alkali water, thereby neutralizing the acid water. Also, washing is preferably done with acid water or alkali water and then rinsing is performed with neutral water.

In the above-described ozone water generator or electrolyzed water generator, the facing electrodes are preferably made of platinum (Pt), a platinum/palladium (Pt/Pd) alloy, a Pt group/Pd alloy, or a conductive metal such as titanium (Ti) coated with Pt, a Pt/Pd alloy or a Pt group/Pd alloy. In case of using the Pt/Pd alloy, 85.0 to 99.95 wt % of Pt and 15.0 to 0.05 wt % of Pd are preferably contained in the alloy. Carbon electrodes having electric conductivity and other electrode properties manufactured by subjecting carbon powder extracted from charcoal or carbon fiber obtained by carbonizing polyacryl fibers to a compressive molding process at high-temperature and high-pressure condition and a high-temperature carbonization process, can also be used for the facing electrodes of the functional water generator according to the present invention. When the carbon electrodes are employed to the functional water generator according to the present invention, they exhibit similar properties and performance to metallic conductors and are cost-efficient.

Also, the distance between the facing electrodes of the functional water generator is preferably 0.1 to 1 mm, and the structure thereof may be a panel type, a flat panel type having one or more holes, a small strip type, a fine wire type, a fish bone type, a mesh type or a cylinder type. Although square electrodes have been illustrated and described in the embodiment, the facing electrodes may have any shapes, including a circular or rectangular shape.

In the ozone water generator or electrolyzed water generator according to the present invention, a direct-current (DC) voltage, a pulse voltage, a square wave pulse voltage, a sequence-controlled pulse voltage or an alternating pulse voltage can be applied to the facing electrodes.

Figure 11:
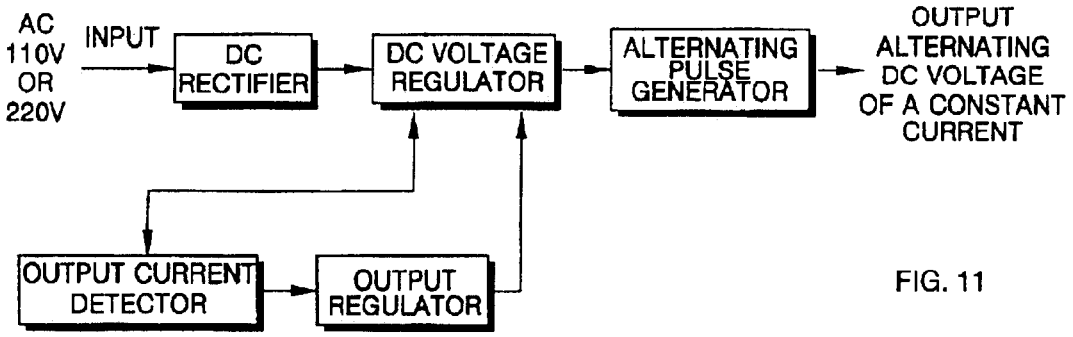
FIG. 11 is a block diagram of a power generation mechanism applied to the functional water generator which can be used in the washing machine according to the present invention.

FIG. 11 is a block diagram of a power generation mechanism applied to the functional water generator which can be used in the washing machine according to the present invention. Here, an AC voltage of 110 or 220 V is applied to a DC rectifier for DC rectification to generate a predetermined DC voltage. Next, the DC voltage regulator detects output current and regulates output current into a constant magnitude to prevent the DC voltage from varying due to the change of the AC voltage of 110 or 220 V. The adjusted DC voltage is output as an alternating DC voltage of a constant current via an alternating pulse generator.

The following examples are provided for showing the cleaning efficiency and sterilizing efficiency of the washing machine having the functional water generator according to the present invention.

EXAMPLE 1

Cleaning Efficiency

One or two sets of ozone water generators shown in FIG. 9 were mounted on a washing tub of the washing machine shown in FIG. 4, and the cleaning efficiency was tested while adjusting currents, voltages and operating times. 30 sheets of JIS contaminated fabrics (weighing 8 kg) were used as laundry and washing process was carried out at room temperature (24° C.) by using a detergent (Super Clean®). While varying the amount of the detergent used, washing process was carried out and the cleaning degree was measured. The cleaning degree was evaluated by the subtractive color system, and the results are shown in Table 1.

TABLE 1

[t2]

| Current (A) | Voltage (V) | Number of ozone water generator(s) mounted | Amount of detergent used | Contact time | Cleaning degree |
|---|---|---|---|---|---|
| — | — | — | 1 g/l (100%) | — | 42% |
| 1 | 20 | 1 | 0.7 g/l (70%) | 10 min (washing, rinsing) | 46% |
| 1 | 20 | 2 | 0.7 g/l (70%) | 20 min (washing, rinsing) | 45% |
| 1 | 20 | 1 | 0.5 g/l (50%) | 10 min (washing, rinsing) | 37% |
| 1 | 20 | 2 | 0.5 g/l (50%) | 10 min (washing, rinsing) | 40% |
| 2 | 30 | 1 | 0.5 g/l (50%) | 10 min (washing, rinsing) | 36% |
| 2 | 30 | 2 | 0.5 g/l (50%) | 10 min (washing, rinsing) | 47% |

As shown in Table 1, when the ozone water generator is employed to the washing machine according to the present invention, the amount of detergent used could be reduced by 30 to 50% while improving the cleaning degree by approximately 4%. Also, when two ozone water generators were mounted, the amount of detergent used could be reduced by approximately 50% while improving the cleaning degree by approximately 5%.

EXAMPLE 2

Cleaning Efficiency

One or two fish bone type electrodes made by coating Pt/Pd alloy on Ti, or one or two mesh type electrodes made by coating Pt on Ti, were used as the facing electrodes of the ozone water generators shown in FIG. 9 and mounted on a washing tub of the washing machine shown in FIG. 4. Then, the cleaning efficiency was tested while adjusting currents and voltages. 3 kg of JIS contaminated fabric was used as laundry and washing process was carried out by using a detergent (Han Spoon®). While varying the amounts of the detergent used, washing process was carried out and the cleaning degree was measured. The cleaning degree was evaluated by the subtractive color system, and the results are shown in Table 2.

TABLE 2

[t1]

| Current (A) | Voltage (V) | Number of ozone water generator(s) mounted | Amount of detergent used (Electrode operating time) | Cleaning degree (Standard deviation) Fish bone type | Mesh type |
|---|---|---|---|---|---|
| — | — | — | 100% (0 min) | 42.5% | |
| 1 | 20 | 1 | 50% (20 min in washing and rinsing) | 43.5% (3.0) | 39.1% (1.9) |
| 1 | 20 | 2 | 50% (20 min in washing and rinsing) | 45.2% (3.2) | 42.8% (2.3) |
| 2 | 40 | 1 | 50% (20 min in washing and rinsing) | 44.1% (2.9) | 40.5% (1.9) |
| 2 | 40 | 2 | 50% (20 min in washing and rinsing) | 44.9% (2.9) | 41.8% (2.3) |
| 2 | 60 | 1 | 50% (20 min in washing and rinsing) | 45.2% (3.2) | 40.9% (2.2) |
| 3 | 60 | 2 | 50% (20 min in washing and rinsing) | 45.8% (3.3) | 43.1% (2.7) |

In Table 2, the cleaning degree was a mean value of three specimens in cases that the current of 2 A was used and one ozone water generator was mounted, and a mean value of two specimens in other cases.

As shown in Table 2, when the ozone water generator is employed to the washing machine according to the present invention, the amount of detergent used could be reduced by 30 to 50% while maintaining the same or higher cleaning degree. The fish bone type electrodes exhibited rather higher effect than the mesh type electrodes. Also, when two ozone water generators were mounted, the cleaning degree increased, as shown in Table 2.

EXAMPLE 3

Sterilizing Efficiency

An ozone water generator shown in FIG. 9 was mounted on a washing tub of the washing machine shown in FIG. 4, and the sterilizing efficiency was tested while adjusting currents. *E.coli* and O-157 were added to tap water in a concentration of 1,400 cells/ml. The washing tub was filled with the bacteria-containing water and then the ozone water generator was operated. Then, the number of bacteria in the water contained in the washing tub was examined according to the lapse of time.

Table 3 shows the number of bacteria according to the operation of the ozone water generator installed in the washing machine according to the present invention.

TABLE 3

[t3]

| | | |
|---|---|---|
| Current (Å) | 1 | 2 |
| Ozone concentration (ppm) | 0.3 | 0.5 |
| Number of bacteria (CFU/0.1 ml) | 140 in raw water | 140 in raw water |
| | 0 after 10 sec | 0 after 5 sec |
| | 0 after 30 sec | 0 after 30 sec |
| | 0 after 60 sec | 0 after 60 sec |

As confirmed from Table 3, after the ozone water generator mounted in the washing machine according to the present invention was operated, the bacteria contained in tap water were completely sterilized in 5 to 10 seconds.

EXAMPLE 4

Sterilizing Efficiency

Bacteria were added to the ozone water generated by operating the ozone water generator shown in FIG. 9 mounted on a washing tub of the washing machine shown in FIG. 4, and then the number of bacteria in the water contained in the washing tub was examined according to the lapse of time. *E.coli* and O-157 were used as bacteria and added to ozone water in concentrations of $2.5\times10^3$ cells/ml and $1.5\times10^3$ cells/ml, respectively. The voltage applied to the ozone water generator was 1 A, and the ozone concentration was 0.3 ppm.

Table 4 shows the sterilizing efficiency of the washing machine according to the present invention.

TABLE 4

[t4]

| | | | |
|---|---|---|---|
| Current (Å) | | 1 | 1 |
| Ozone concentration (ppm) | | 0.3 | 0.3 |
| Number of bacteria (CFU/0.1 ml) | Raw water | 250 | 150 |
| | After 10 sec | 18 | 0 |
| | After 30 sec | 0 | 0 |
| | After 60 sec | 0 | 0 |

As confirmed from Table 4, even when tap water was severely contaminated with bacteria, the washing machine according to the present invention could sterilize over 90% of bacteria in 10 seconds.

As described above, in the washing machine with a functional water generator according to the present invention, when washing water supplied to a washing tub reaches a constant level, the functional water generator is operated to generate ozone water or electrolyzed water, which is then mixed by an agitator. Thus, partial decoloration or damage of the laundry can be prevented. Also, in the washing machine of the present invention, since ozone water or electrolyzed water having various functions such as sterilization, disinfection, bleaching and deodorization is maintained in a constant concentration in the washing tub, the laundry can be sterilized, disinfected, bleached and deodorized without being heated, which causes no damage to the laundry, thereby greatly improving the cleaning efficiency by reducing the amount of detergent used and increasing the cleaning degree.

What is claimed is:

1. A washing machine having:

a water supplier for supplying washing water;

a washing tub for containing the washing water supplied from the water supplier and a laundry;

a functional water generator provided in the lower portion of the washing tub to generate functional water in the washing water supplied to the washing tub; and an agitator for agitating the washing water and the laundry contained in the washing tub, wherein the functional water generator is an ozone water generator having at least one pair of facing electrodes or an electrolyzed water generator having at least one pair of facing electrodes disposed with a separating layer interposed therebetween.

2. The washing machine according to claim 1, wherein the facing electrodes are made of platinum (Pt), a platinum/palladium (Pt/Pd) alloy or a Pt group/Pd alloy.

3. The washing machine according to claim 1, wherein the facing electrodes are made of a conductive metal coated with platinum (Pt), a platinum/palladium (Pt/Pd) alloy or a Pt group/Pd alloy.

4. The washing machine according to claim 3, wherein the conductive metal is titanium (Ti).

5. The washing machine according to claim 1, wherein the facing electrodes are carbon electrodes having electric conductivity.

6. The washing machine according to claim 1, wherein the facing electrodes are of a panel type, a flat panel type having one or more holes, a small strip type, a fine wire type, a fish bone type, a mesh type or a cylinder type, and the distance of the facing electrodes is in the range of 0.1 to 1 mm.

7. The washing machine according to claim 1, further comprising a power source for applying a direct-current (DC) voltage, a pulse voltage, a square wave pulse voltage, a sequence-controlled pulse voltage or an alternating pulse voltage the ozone water generator.

8. The washing machine according to claim 1, further comprising:

a power source for applying a voltage to the ozone water generator;

a sensor for sensing whether the washing water supplied from the water supplier reaches a predetermined level in the washing tub; and a controller for receiving information of the level of the washing water in the washing tub from the sensor and controlling the voltage to be applied to the power source.

9. The washing machine according to claim 8, wherein the controller controls the operations of a water supply valve for supplying the washing water to the washing tub and a drain valve for draining the washing water from the washing tub.

10. The washing machine according to claim 1, further comprising:

a power source for applying a voltage to the functional water generator;

a sensor for sensing the concentration of the ozone water in the water tub; and a controller for receiving information of the concentration of the ozone water from the sensor and controlling the voltage to be applied to the power source.

11. The washing machine according to claim 10, wherein the controller controls the operations of a water supply valve for supplying the washing water to the washing tub and a drain valve for draining the washing water from the washing tub.

12. A washing method performed by a washing machine, comprising the steps of:

supplying washing water to a washing tub;

generating ozone water in the washing water supplied to the washing tub;

sensing the level of the washing water supplied to the washing tub;

controlling the generation of the ozone water in accordance with the level of the washing water;

mixing a laundry with the ozone water; and draining the ozone water.

13. A washing method performed by a washing machine, comprising the steps of:

supplying washing water to a washing tub;

generating ozone water in the washing water supplied to the washing tub;

sensing the concentration of the ozone water in the washing tub;

controlling the generation of the ozone water in accordance with concentration of the washing water;

mixing a laundry with the ozone water; and draining the ozone water.

* * * * *